US008371907B2

(12) United States Patent
Clayton

(10) Patent No.: US 8,371,907 B2
(45) Date of Patent: Feb. 12, 2013

(54) ROTARY DUST PROTECTION APPARATUS

(76) Inventor: Brad Smythe Clayton, Brick, NJ (US)

( * ) Notice: Subject to any disclaimer, the term of this patent is extended or adjusted under 35 U.S.C. 154(b) by 361 days.

(21) Appl. No.: 12/690,187

(22) Filed: Jan. 20, 2010

(65) Prior Publication Data

US 2011/0177763 A1 Jul. 21, 2011

(51) Int. Cl.
*B24B 23/00* (2006.01)

(52) U.S. Cl. ..... 451/344; 451/357; 451/455; 451/456; 451/356

(58) Field of Classification Search ..... 451/456, 451/357–359
See application file for complete search history.

(56) References Cited

U.S. PATENT DOCUMENTS

| | | | | | |
|---|---|---|---|---|---|
| 2,074,818 | A * | 3/1937 | Watson | 55/338 |
| 2,252,160 | A * | 8/1941 | Blood | 451/359 |
| 2,707,854 | A * | 5/1955 | Johnson | 451/344 |
| 2,954,653 | A * | 10/1960 | Harvey | 451/456 |
| 3,256,648 | A * | 6/1966 | Subonovich | 451/456 |
| 3,826,045 | A * | 7/1974 | Champayne | 451/359 |
| 3,882,644 | A * | 5/1975 | Cusumano | 451/359 |
| 4,022,182 | A * | 5/1977 | Lenkevich | 125/13.01 |
| 4,164,101 | A * | 8/1979 | Robert | 451/456 |
| 5,105,585 | A * | 4/1992 | Hampl et al. | 451/359 |
| 5,125,190 | A * | 6/1992 | Buser et al. | 451/456 |
| 5,228,244 | A * | 7/1993 | Chu | 451/456 |
| 5,384,984 | A * | 1/1995 | Smith | 451/357 |
| 5,419,737 | A * | 5/1995 | Brazell et al. | 451/453 |
| 5,545,082 | A * | 8/1996 | Courson et al. | 451/456 |
| 5,791,979 | A * | 8/1998 | Duncan et al. | 451/456 |
| 5,993,305 | A * | 11/1999 | Chu | 451/357 |
| 6,561,887 | B2 * | 5/2003 | Lai et al. | 451/358 |
| 7,118,609 | B2 * | 10/2006 | Valentini | 55/385.1 |
| 2002/0031992 | A1 * | 3/2002 | Clowers et al. | 451/357 |

* cited by examiner

*Primary Examiner* — George Nguyen
(74) *Attorney, Agent, or Firm* — Myers Wolin, LLC; Scott H. Kaliko

(57) ABSTRACT

A rotary abrasive device and for facilitating the removal of dust from a work surface. The rotary abrasive device may include a plenum, a plenum coupled to a vacuum source via a plenum exhaust. The shape of said plenum may be varied depending upon application. The plenum exhaust is right biased in a clockwise shaft rotation in order to pick-up debris off of a clockwise rotating abrasive device. The invention may include a rotary constraining member to allow the shaft to rotate freely through the plenum and a locking means to keep the plenum in a substantially fixed position. According to further illustrative embodiments of this aspect of the invention, the plenum one or more inlets of a fixed or varying width to pick-up debris off of a work surface.

6 Claims, 6 Drawing Sheets

ROTARY DUST PROTECTION APPARATUS

BACKGROUND OF THE INVENTION

The invention relates generally to an apparatus for controlling exposure to dust during, for example, sanding, grinding operations. More particularly, the invention relates to an apparatus that limits a user's exposure to dust and other particulate on a rotary abrasive device.

Dust generated during the sanding and grinding operations can be hazardous to those performing the sanding or grinding operations and to those in proximity to such operations. The dust and other particulate matter generated from sanding and grinding operations may contain chromates, lead, and other hazardous materials. At a minimum, the dust and particulate matter generated can cause respiratory issues when inhaled.

For a number of years, different companies have created products to deal with dust collection. Sanders, for example, generally have a shroud that attaches to the body of the sander and covers the "backup pad", i.e., the softer pad to which an abrasive is normally attached. Dust is typically drawn upwards through holes in an abrasive disc and then through corresponding holes in the backup pad. The dust is then captured by a vacuum and sent through an exhaust. These prior art dust collections methods work well on vertical sanders and grinders but are limited in their capabilities when it comes to angled rotary abrasive devices.

The prior art typically describes shrouds that are aluminum or plastic and that mount to the body of a tool in order to support a vacuum shroud. This type of mounting requires that each tool have its own shroud as tool bodies vary greatly among each other.

SUMMARY OF THE INVENTION

It is an object of the invention to provide an improved suction device for the removal of dust and particulate for rotary abrasive devices.

It is another object of the invention to provide an alternative to tool specific dust prevention solutions such as special purpose shroud designs and attachment mechanisms per tool.

In accord with aforestated objects and other aspects of the invention, which will be discussed in detail below, one aspect of the invention provides a tool for holding a rotary abrasive device and for facilitating the removal of dust created by the rotary abrasive device. This aspect of the invention also provides a shaft that is coupled to the rotary abrasive device. This aspect of the invention may also include a plenum, wherein the plenum is coupled to a vacuum source via a plenum exhaust, and wherein the shape of said plenum may be varied depending upon application, and wherein the plenum exhaust is right biased in a clockwise shaft rotation shaft configuration in order to pick-up debris off of a clockwise rotating abrasive device. This aspect of the invention may include at least one rotary constraining member to allow the shaft to rotate freely through the plenum, and a locking means to keep the plenum in a substantially fixed position.

According to further illustrative embodiments of this aspect of the invention, the plenum may include a translucent section to allow for visibility of the rotary abrasive device.

Still further illustrative embodiments of this aspect of the invention may include a bushing that may act as a rotary constraining member.

Yet another illustrative embodiment of this aspect of the invention may include a bearing that may act as a rotary constraining member.

Yet still further another illustrative embodiment of this aspect of the invention may include a variable sized inlet located about the peripheral edge of the plenum.

BRIEF DESCRIPTION OF THE DRAWINGS

The above and other objects, features, and advantages of the invention will be apparent upon consideration of the following detailed description, taken in conjunction with the accompanying drawings, in which like reference characters refer to like parts throughout.

DETAILED DESCRIPTION OF THE INVENTION

Figure 1:
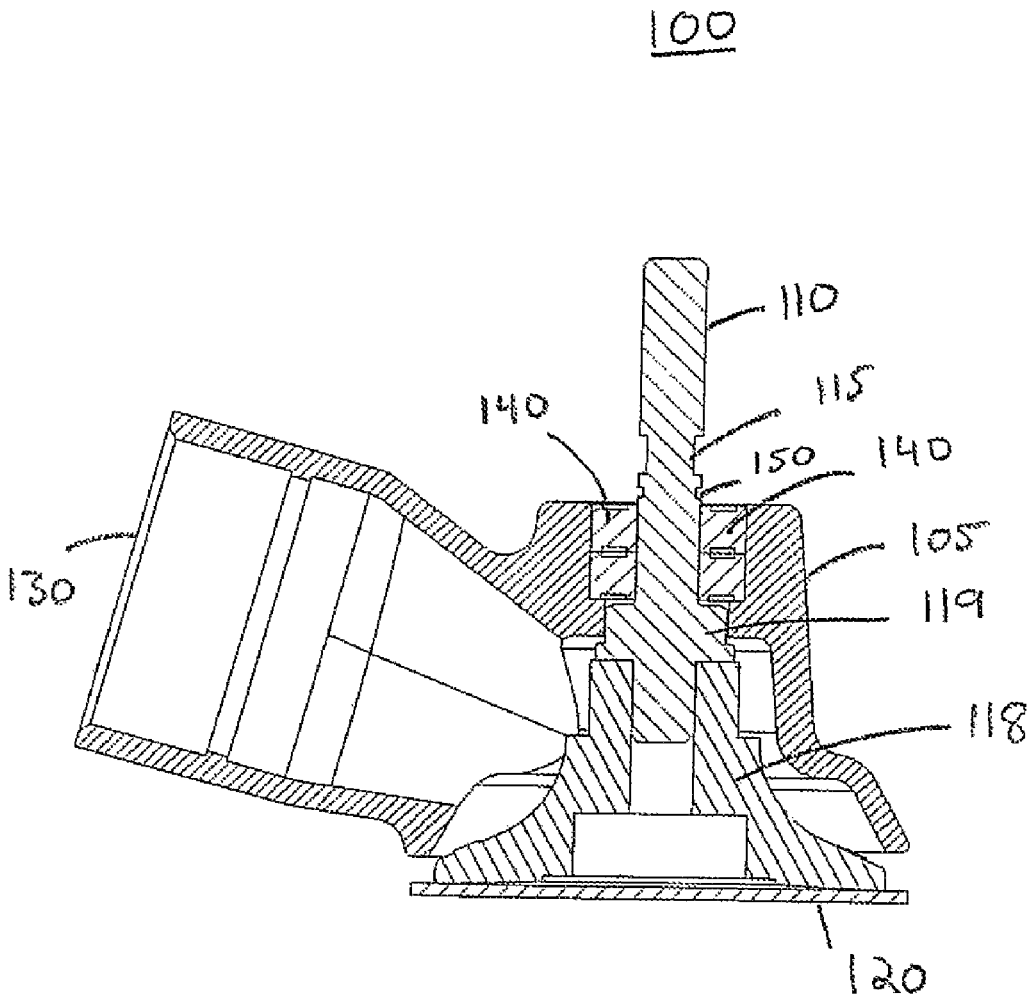
FIG. 1 depicts a side cross-section of an illustrative embodiment of aspects of the present invention.
Figure 5:
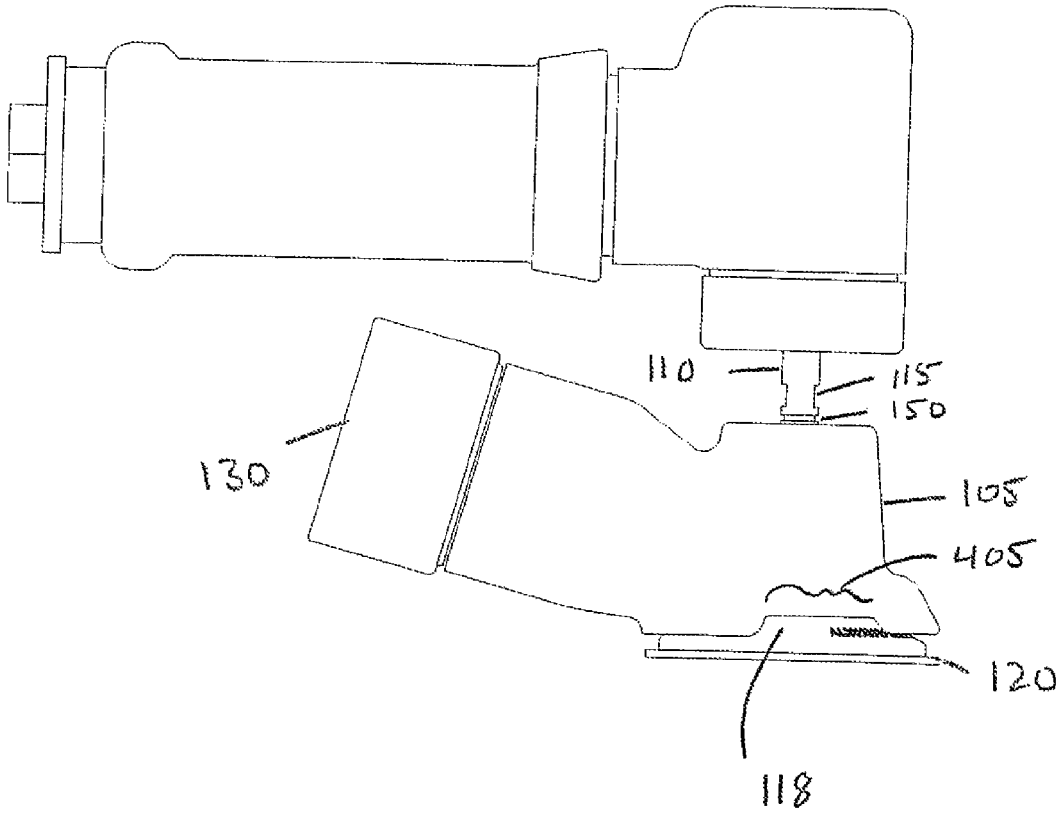
FIG. 5 is a side view of an illustrative embodiment of an aspects of the present invention.
Figure 6:
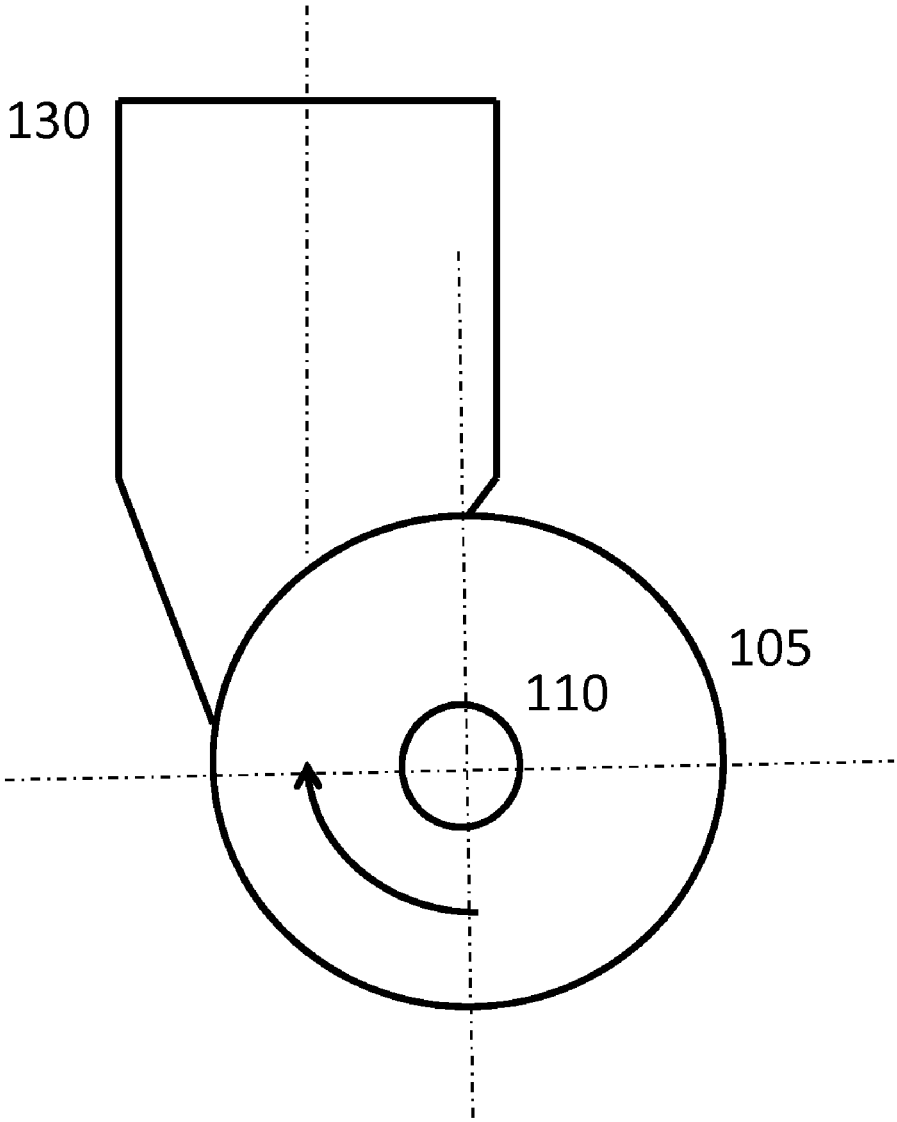
FIG. 6 is a top view of an illustrative embodiment of an aspect of the present invention.

According to FIG. 1, system 100 according to the present invention may include Plenum 105, Shaft 110 that is coupled to Rotary Abrasive Device 120 (as shown in FIG. 5) via Backup Pad 118. This aspect of the invention may also include Plenum Exhaust 130 that may be coupled to a vacuum source (not shown). FIG. 1 also shows Rotary Constraining means 140 and Locking Means 150.

According to present invention Shaft 110 may be, for example, constructed of steel, aluminum, or any other suitable material. Shaft 110 may include Backup Pad Notch 115. Backup Pad Notch 115 may be used so that shaft 110 may be held with a wrench, pliers, or other suitable tool in order to securely attach Backup Pad 118 to Shaft 110 without the wrench or other tool slipping about Shaft 110. Shaft 110 may also include retaining notch 150 and/or a pin hole (not shown) to accept Locking Means 210 (as shown on FIG. 2) that substantially prevents plenum 105 from vertically moving on Shaft 110.

Figure 2:
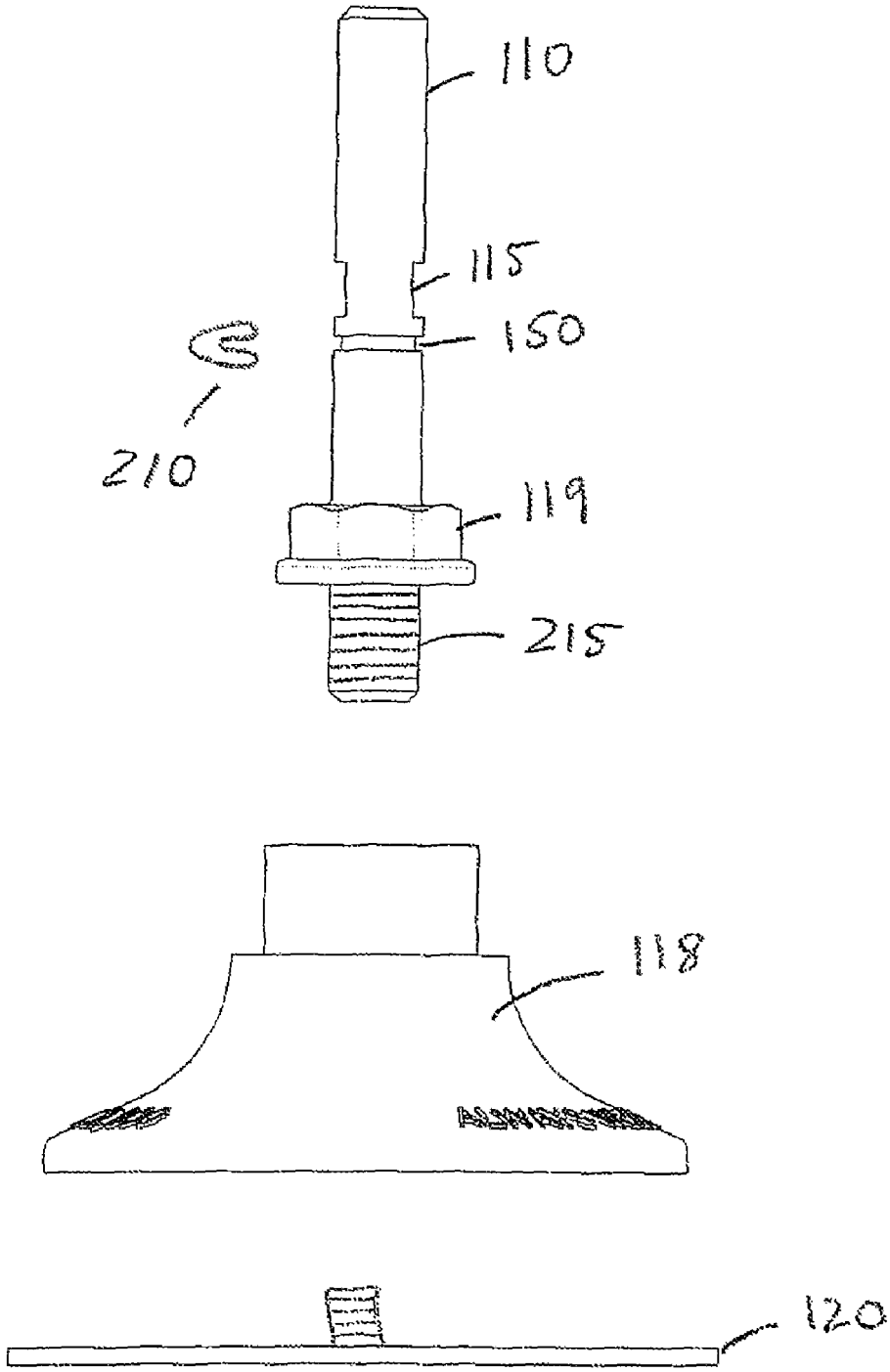
FIG. 2 depicts a side view of an illustrative embodiment of an aspect of the present invention.

Shaft 110 may include Backup Pad. Backstop 119. Backup Pad Backstop 119 may be, for example, a hex nut (as shown in FIG. 2) or any other suitable device or means to prevent Backup Pad 118 from traveling up Shaft 110. Shaft 110 may also include Threads 215 to secure Backup Pad 118 to Shaft 110.

FIG. 1 also shows Rotary Abrasive Device 120 and Backup Pad 118. Rotary Abrasive Device 120 may, for example, be any fixed or replaceable abrasive pad designed to be used with an electric, hydraulic or pneumatic rotary sanding, grinding, or similar tool. Backup Pad 118 may, for example, be constructed of a tough, durable plastic, rubber, conformable foam, or any other suitable material that is lightweight, shock resistant, and well balanced that couples Rotary Abrasive Disk 120 to Shaft 110.

FIG. 1 also shows Plenum 105. Plenum 105 may be constructed from various materials such as durable plastic, aluminum, durable ceramics, or any other suitable materials. Plenum 105 surrounds Backup Pad 118, is located above Rotary Abrasive Device 120, and substantially extends to the peripheral edge of Rotary Abrasive device 120. Additionally, Shaft 110 vertically extends through the top portion of and is coupled to Plenum 105 with Rotary Constraining Means 140 and Locking Means 150.

Rotary Constraining Means 140 may, for example, be one or more bearings, bushings, or other suitable means to allow Shaft 110 to rotate freely at low and high speeds while allowing Plenum 105 to maintain a substantially or relatively fixed position when in operation. More particularly, Rotary Constraining Means 140 may be a sealed bearing, a roller bearing, a bushing, lubricated sleeve, or any other suitable means to allow Plenum 105 to maintain a substantially or relatively fixed position when Shaft 110 is rotating.

Locking Means 210 is used to keep Plenum 105 in a substantially fixed position on Shaft 110. Locking Means 210 may be, for example, a spring clip, a pin, or any other suitable device that keeps Plenum 105 in a substantially fixed position.

Plenum 105 may also include Plenum Exhaust 130. Plenum Exhaust 130 may be an outlet from Plenum 105 and may be coupled to vacuum source (not shown) via a hose and clamps/couplings (not shown) or by any other suitable means to remove dust and debris from the work surface and within Plenum 105.

Figure 3:
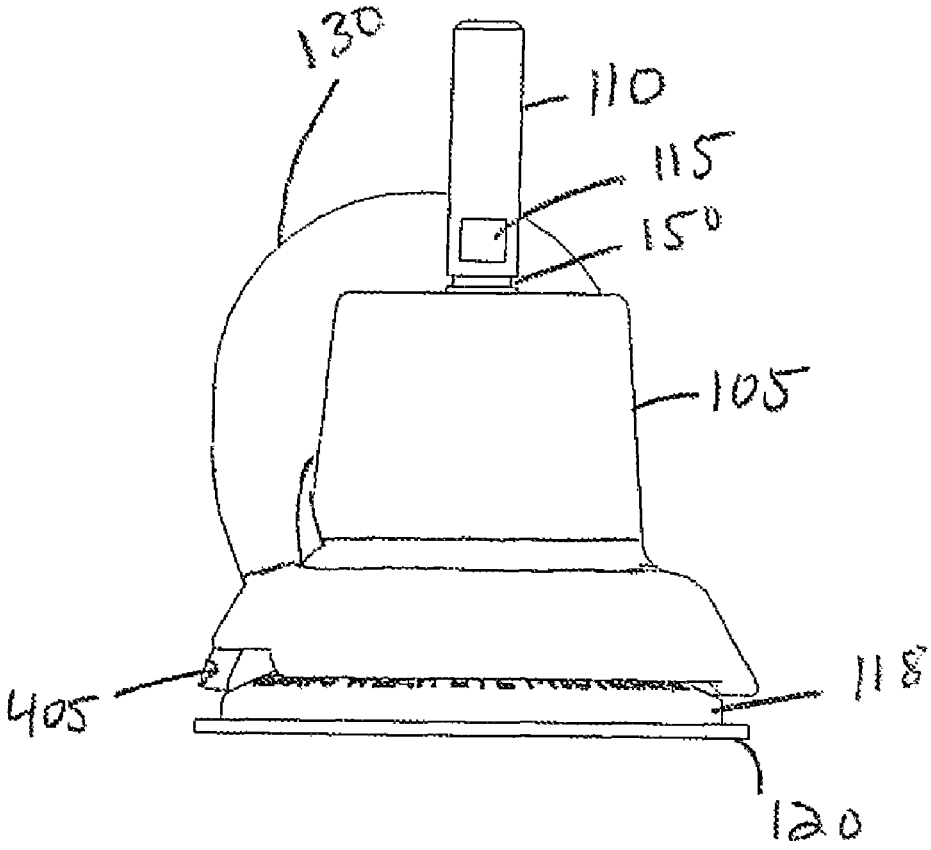
FIG. 3 depicts is a front view of an illustrative embodiment of an aspect of the present invention.

Plenum 105 may also be "right biased" (from the perspective of the user) as shown in FIG. 3. As mentioned above, Plenum 105 may include Plenum Exhaust 130 that may be coupled to a vacuum source. The right biased construction of Plenum 105 allows the vacuum source to be applied in the most advantageous location in order to remove dust, debris, and particulate from within Plenum 105 and the work surface. This aspect of the invention may include least one rotary constraining member to allow the shaft to rotate freely through the plenum, and a locking means to keep the plenum in a substantially fixed position.

Figure 4:
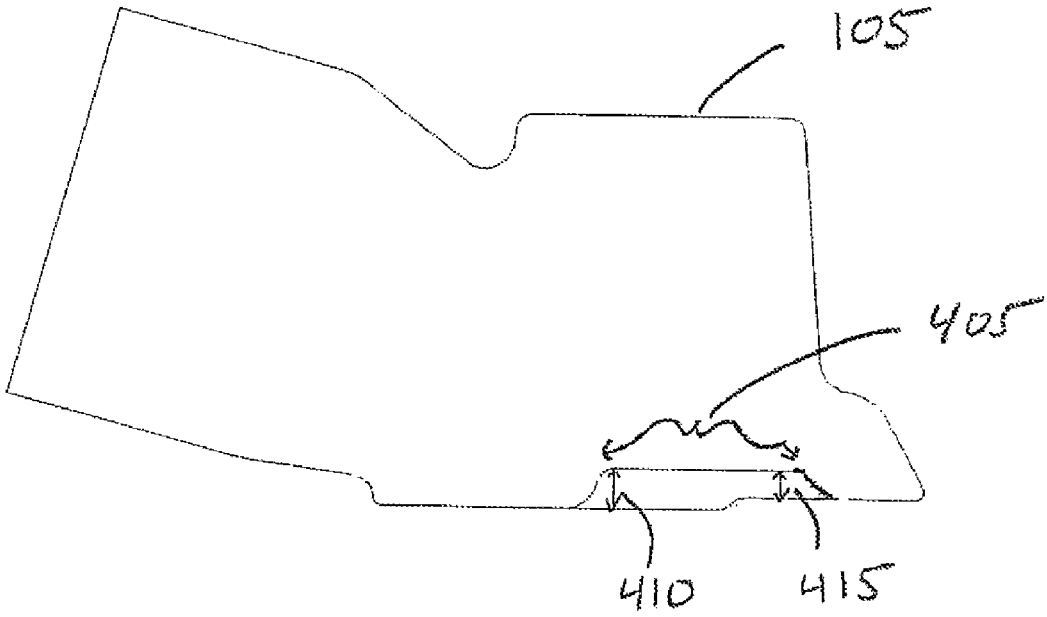
FIG. 4 is a side view of an illustrative embodiment of an aspect of the present invention.

Plenum 105 may also have Inlet 405, as shown in FIG. 4). Inlet 405 may be located on the right peripheral edge (from the perspective of the user) of Plenum 105. Inlet 405, may be a single width from the peripheral edge of Plenum 105 or may be constructed with variable widths from the peripheral edge of Plenum 105. As shown in FIG. 4, the peripheral edge of Plenum 105 includes Inlet 405 that is made up of width 410 and width 420. Having a plurality of widths allows Inlet 405 to have an increased suction to be generated though Plenum 105 and in the proximity outside of Inlet 405.

Plenum 105 may have two inlets 405. Each inlet may have a different width or the same width. For example, the first inlet may have a width of 0.25 inches and the second inlet may have a width of 0.025 inches about the peripheral edge of the plenum to enhance airflow. The preferred range of the one or more inlets 405 is from 0.025 inches to 0.25 inches.

FIG. 5 is an illustrative example of various aspects of the present invention as attached to a right angled rotary tool.

Described and illustrated herein is a Rotary Dust Protection Apparatus. While particular embodiments of the invention have been described, it is not intended that the invention be limited thereto, as it is intended that the invention be as broad in scope as the art will allow and that the specification be read likewise. It will therefore be appreciated by those skilled in the art that certain modifications could be made to the provided invention without deviating from its spirit and scope as so claimed.

What is claimed:

1. A tool for holding a rotary abrasive device and for facilitating the removal of dust created by the rotary abrasive device, comprising:

a shaft, wherein the rotary abrasive device is coupled to the shaft;

a plenum located above the rotary abrasive device, wherein the plenum exhaust is right biased in a clockwise rotation of the shaft in order to pick-up debris off of a clockwise rotating abrasive device;

at least one rotary constraining member to allow the shaft to rotate freely through the plenum; and a locking means to keep the plenum in a substantially fixed position, wherein the plenum has at least one variable sized cut-out inlet about the peripheral edge of the plenum to enhance airflow.

2. The tool of claim 1, wherein the plenum includes a translucent portion to allow visibility of the rotary abrasive device.

3. The tool of claim 1, wherein the rotary constraining member is a bearing.

4. The tool of claim 1, wherein the rotary constraining member is a bushing.

5. The tool of claim 1, wherein the plenum is the mechanical support for the rotary constraining member and a vacuum coupling device.

6. A tool for holding a rotary abrasive device and for facilitating the removal of dust created by the rotary abrasive device, comprising:

a shaft, wherein the rotary abrasive device is coupled to the shaft;

a plenum located above the rotary abrasive device, wherein the plenum is coupled to a vacuum source via a plenum exhaust, and wherein the plenum exhaust is right biased in a clockwise rotation of the shaft in order to pick-up debris off of a clockwise rotating abrasive device;

at least one rotary constraining member to allow the shaft to rotate freely through the plenum;

a locking means to keep the plenum in a fixed position; and wherein the plenum has an cut-out inlet with a changing width, wherein the range of the changing inlet is from 0.025 inches to 0.25 inches about the peripheral edge of the plenum to enhance airflow.

* * * * *